US008235086B2

(12) United States Patent
Smith

(10) Patent No.: US 8,235,086 B2
(45) Date of Patent: Aug. 7, 2012

(54) SYSTEM, METHOD AND APPARATUS FOR AREA SCREEN COVERAGE

(76) Inventor: Richard C. Smith, Homosassa, FL (US)

( * ) Notice: Subject to any disclaimer, the term of this patent is extended or adjusted under 35 U.S.C. 154(b) by 0 days.

(21) Appl. No.: 12/558,875

(22) Filed: Sep. 14, 2009

(65) Prior Publication Data

US 2011/0061817 A1 Mar. 17, 2011

(51) Int. Cl.
*E06B 9/08* (2006.01)

(52) U.S. Cl. ..... 160/122; 160/120; 160/98; 160/352

(58) Field of Classification Search ..... 160/121.1, 160/120, 122, 133, 108, 309, 238, 98, 241, 160/312, 87, 242, 352, DIG. 18
See application file for complete search history.

(56) References Cited

U.S. PATENT DOCUMENTS

| | | | | |
|---|---|---|---|---|
| 1,925,815 | A * | 9/1933 | Nicolson | 135/97 |
| 1,959,136 | A * | 5/1934 | Miller | 160/268.1 |
| 2,060,582 | A * | 11/1936 | Leffert | 160/120 |
| 3,763,917 | A | 10/1973 | Antinone | |
| 4,100,957 | A | 7/1978 | Shelton | |
| 5,123,474 | A * | 6/1992 | Smith | 160/310 |
| 5,217,057 | A | 6/1993 | Hubbard | |
| 5,259,656 | A * | 11/1993 | Carroll | 296/77.1 |
| 5,323,835 | A | 6/1994 | Bechmeier | |
| 5,427,169 | A * | 6/1995 | Saulters | 160/368.1 |
| 6,079,473 | A | 6/2000 | Ackerson, II | |
| 6,082,429 | A * | 7/2000 | Ochoa | 160/201 |
| 6,691,761 | B1 | 2/2004 | Alkhoury | |
| 6,705,378 | B1 | 3/2004 | Smidt | |
| 7,320,353 | B1 | 1/2008 | Miller | |

FOREIGN PATENT DOCUMENTS

| | | |
|---|---|---|
| GB | 187800 | 11/1922 |

OTHER PUBLICATIONS

Definition of "Awning" Century Dictionary. Downloaded from http://www.wordnik.com/words/awning.*
Definition of "Screen" American Heritage Dictionary. Downloaded from http://www.wordnik.com/words/screen.*

* cited by examiner

*Primary Examiner* — Katherine w Mitchell
*Assistant Examiner* — Johnnie A Shablack
(74) *Attorney, Agent, or Firm* — Larson & Larson, P.A.; Frank Liebenow; Justin P. Miller

(57) ABSTRACT

A multi-section screen system includes a first of the flexible sheets of screen material that has zipper teeth along at least one side edge and a neighboring second flexible sheet of screen material that has mating zipper teeth along an abutting side edge. Mechanisms retract and deploy each of the flexible sheets in unison. A fastener is fixedly disposed between each two of the mechanisms. The fasteners automatically join the zipper teeth with the mating zipper teeth as the mechanisms deploy the flexible sheets and the fasteners automatically disengaging the zipper teeth from the mating zipper teeth as the mechanisms retract the flexible sheets.

20 Claims, 5 Drawing Sheets

SYSTEM, METHOD AND APPARATUS FOR AREA SCREEN COVERAGE

FIELD OF THE INVENTION

This invention relates to the field of screens and more particularly to a system for deploying screens.

BACKGROUND

Deployable screen systems are well known in the industry. There are many reasons for using a deployable screen as opposed to fixed screens. For example, in areas where insects or other pests are present for only part of the day or for a season, screens are only needed during such time when the pest is present. Another example is in areas which are not used during certain periods. For example, a porch need not be screened during the winter months in Duluth, Minn., because it is too cold to use the porch during winter and, even if used, there would be no pests that need to be kept out.

Often, deployable screens include a flexible screen fabric that is stored on a roller (when not in use) and weighted along a bottom edge to allow deployment as the screen fabric is unrolled. In some cases, the left and right edges of the screen fabric are in a track to seal the screen over a certain area. Such systems function well for an area that is bounded by walls and of limited size, but for larger areas or areas not bounded by walls, such systems have performance problems.

For large areas such as wide garage doors, hanger doors and the like, the roller for storing such deployable screens of the prior art must be long enough as to contain the width of the screens. This results in very long rollers that need to be very rigid since a center support is not feasible due to the continuous width of the screen fabric. If the long rollers are not stiff enough, bowing results and the screen does not deploy evenly and bends and/or creases as it is retracted.

For areas that are not bounded by walls, it is very difficult to provide deployable screen solutions. For example, if there is a roof providing a top cover and three open sides areas, as often found in porch areas, but no corner structures, three separate deployable screens are required, one for each of the open sides. Because this porch area has no corner structures, there is no way to provide a side track for each of the screen fabrics when they are deployed. This leaves each of the two corners open after deployment, requiring some method of fastening to prevent unwanted pests/insects from entering at the corners. Before retraction, the fasteners require disengagement or the screen fabric will be damaged.

What is needed is a system for automatically deploying screens over a large area.

SUMMARY OF THE INVENTION

In one embodiment, a multi-section screen system is disclosed including at least two flexible sheets of screen material. A first of the flexible sheets of screen material has zipper teeth disposed along at least one side edge and a neighboring other of the flexible sheets of screen material has mating zipper teeth disposed along an abutting side edge. Mechanisms retract and deploy each of the flexible sheets of screen material in unison. A fastener is fixedly disposed between each two of the mechanisms. The fasteners join the zipper teeth with the mating zipper teeth as the mechanisms deploy the flexible sheets and the fasteners disengaging the zipper teeth from the mating zipper teeth as the mechanisms retract the flexible sheets.

In another embodiment, a method of enclosing an area with multiple flexible sheets of material is disclosed including providing a first flexible sheet and a second flexible sheet. The first flexible sheet has zipper teeth disposed along a side edge and the second flexible sheet has mating zipper teeth disposed along one of its side edges; the side edge of the first flexible sheet abuts the side edge of the second flexible sheets. A first roller mechanism is provided for retracting and deploying the first flexible sheet and a second roller mechanism is provided for retracting and deploying the second flexible sheet. A fastener is fixedly disposed between the first roller mechanism and the second roller mechanism such that the zipper teeth and the mating zipper teeth interfaced with the fastener. The method includes the step of turning the roller mechanisms in unison in a first direction resulting in the flexible sheets unrolling from the roller mechanisms. As the flexible sheets unroll from the roller mechanisms, the zipper teeth are automatically locked together with the mating zipper teeth by the fastener thereby joining the first flexible sheet to the second flexible sheet. In another step, the roller mechanisms are turned in unison in an opposite direction resulting in the flexible sheets rolling onto the roller mechanisms. As the flexible sheets roll onto the roller mechanism, the zipper teeth are automatically disengaged from the mating zipper teeth by the fastener.

In another embodiment, a multi-section screen system is disclosed including a first flexible sheet with zipper teeth disposed along it right side edge and a second flexible sheet with mating zipper teeth disposed along its left side edge. The system includes a first roller mechanism to which a top edge of the first flexible sheet is interfaced such that turning of the first roller mechanism in a first direction results in winding of the first flexible sheet around the first roller mechanism and turning of the first roller mechanism in an opposing second direction results in unwinding of the first flexible sheet from around the first roller mechanism. The system also includes a second roller mechanism to which a top edge of the second flexible sheet is interfaced such that turning of the second roller mechanism in the first direction results in winding of the second flexible sheet around the second roller mechanism and turning of the second roller mechanism in the opposing second direction results in unwinding of the second flexible sheet from around the second roller mechanism. The right end of the first roller mechanism is in proximity to the left end of the second roller mechanism so that a fastener that is fixedly disposed between the first roller mechanism and the second roller mechanism accepts the zipper teeth and the mating zipper teeth thereby automatically joining the zipper teeth with the mating zipper teeth as the first roller mechanism and the second roller mechanism turns in the first direction (deploying the flexible sheets), and the fastener automatically disengages the zipper teeth from the mating zipper teeth as the first roller mechanism and the second roller mechanism turns in the second opposing direction (retracting the flexible sheets).

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
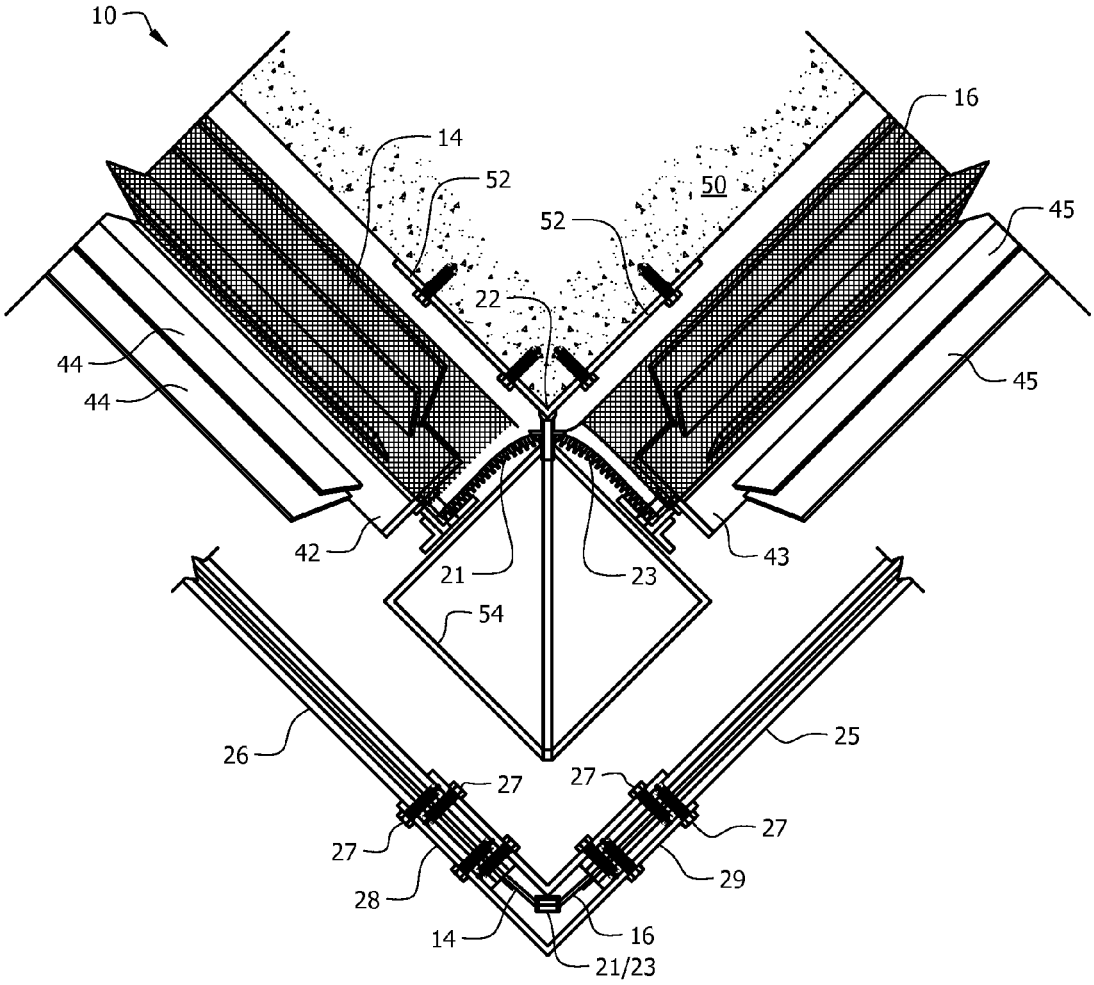
FIG. 1 illustrates a perspective view of a system of the present invention.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a perspective view of a system of the present invention 10 is shown looking from the top. In this example, two screen fabrics 14/16 are deployable at an angle to each other, for example a 90 degree angle as shown. Although a 90 degree angle is shown, any desired angle between the screen fabrics 14/16 is anticipated. This example is similar to that encountered in a porch that is covered but lacks corner supports.

Although screen fabric 14/16 is shown in all examples, any flexible sheet of material is anticipated such as cloth, canvas, etc. It is also anticipated that in some embodiments, one or more of the flexible sheets of material has integrated features such as closable opening, windows (e.g. when the material is opaque), etc.

It is known to use a zipper mechanism to attach flexible sheets to each other. One example of such is canvas boat covers, in which multiple canvas, screen or clear plastic sheets are attached to each other using zippers and/or hook and loop material. In such, a person must position each pair of sheets, and then engage the zipper mechanism to connect one flexible sheet to the next.

In the present invention, a first flexible sheet 14 is automatically engaged with a second flexible sheet 16 as the sheets 14/16 are deployed and the a first flexible sheet 14 is disengaged from the second flexible sheet 16 as the flexible sheets 14/16 are retracted.

The exemplary system of FIG. 1 shows two flexible sheets of screen material 14/16. The first flexible sheet of screen material 14 has a first set of teeth 21 along a right edge and the second flexible sheet of screen material 16 has a mating set of teeth 23 along a left edge, such that, when deployed, the teeth 21/23 are in proximity of each other. As the flexible sheets of screen material 14/16 are deployed from the roller arrangements 42/43/44/45, the teeth 21/23 pass through a fastener 22 that locks the first set of teeth 21 into the mating set of teeth 23, thereby automatically affixing the first flexible sheet of screen material 14 to the second flexible sheet of screen material 16. The fastener 22 is fixed in a location between the first roller arrangement 42/44 and the second roller arrangement 43/45. Likewise, as the flexible sheets of screen material 14/16 are retracted, the teeth 21/23 pass through the fastener 22 in the opposite direction in which the first set of teeth 21 are automatically disengaged from the mating set of teeth 23, thereby allowing the first flexible sheet of screen material 14 to roll up on a first roller arrangement 42/44 and the second flexible sheet of screen material 16 to roll up on a second roller arrangement 43/45. Any form of roller arrangement 42/43/44/45 is anticipated. The example shown has a roller body 42/43 and fins 44/45. The fins 44/45 of such a roller arrangement 42/43/44/45, for example, strengthens the roller arrangement 42/43/44/45 to reduce bending, provides for cooling of the motor (not visible) by convection cooling and enables a flow of air beneath the flexible sheets of material 14/16 when the flexible sheets of material 14/15 are on the roller arrangement 42/43/44/45 to improve drying.

It is anticipated that the roller mechanism 42/43/44/45 is rotated to deploy and retract the flexible material 14/16 by any mechanism as known in the industry including, but not limited to, motors, hand cranks, etc. Such rotation mechanism is required to deploy and retract both flexible sheets of material 14/15 at the same rate (in unison) to prevent skewing. In the example of FIG. 1, the deploying/retracting mechanism is interfaced to the rollers 42/43 at the end that is not shown. In some embodiments, the motors are housed within the support bracket assembly 52/54. Although a single motor with a universal joint coupler adapted to drive two deploying/retracting mechanisms is preferred, separate motors, one for each deploying/retracting mechanism is anticipated as well.

Figure 4:
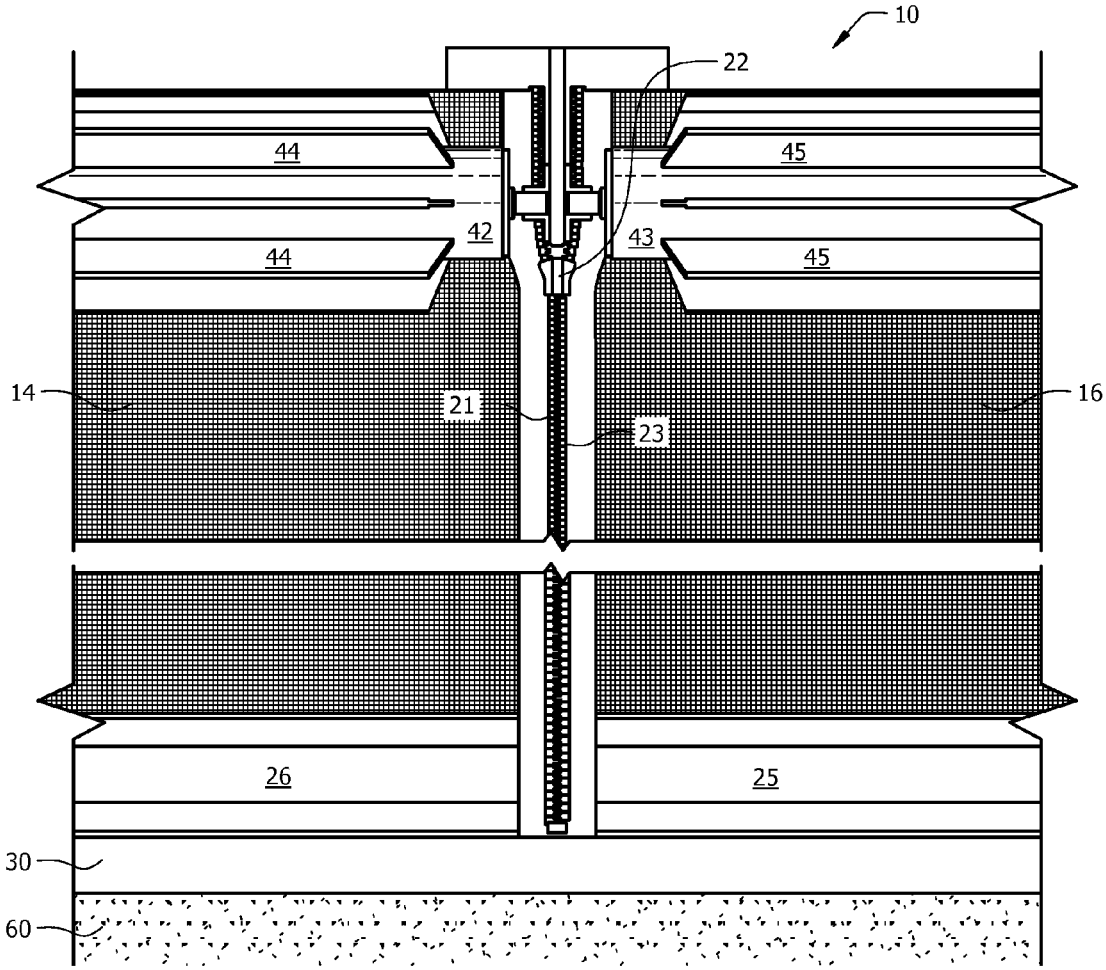
FIG. 4 illustrates a fourth perspective view of the present invention.
Figure 5:
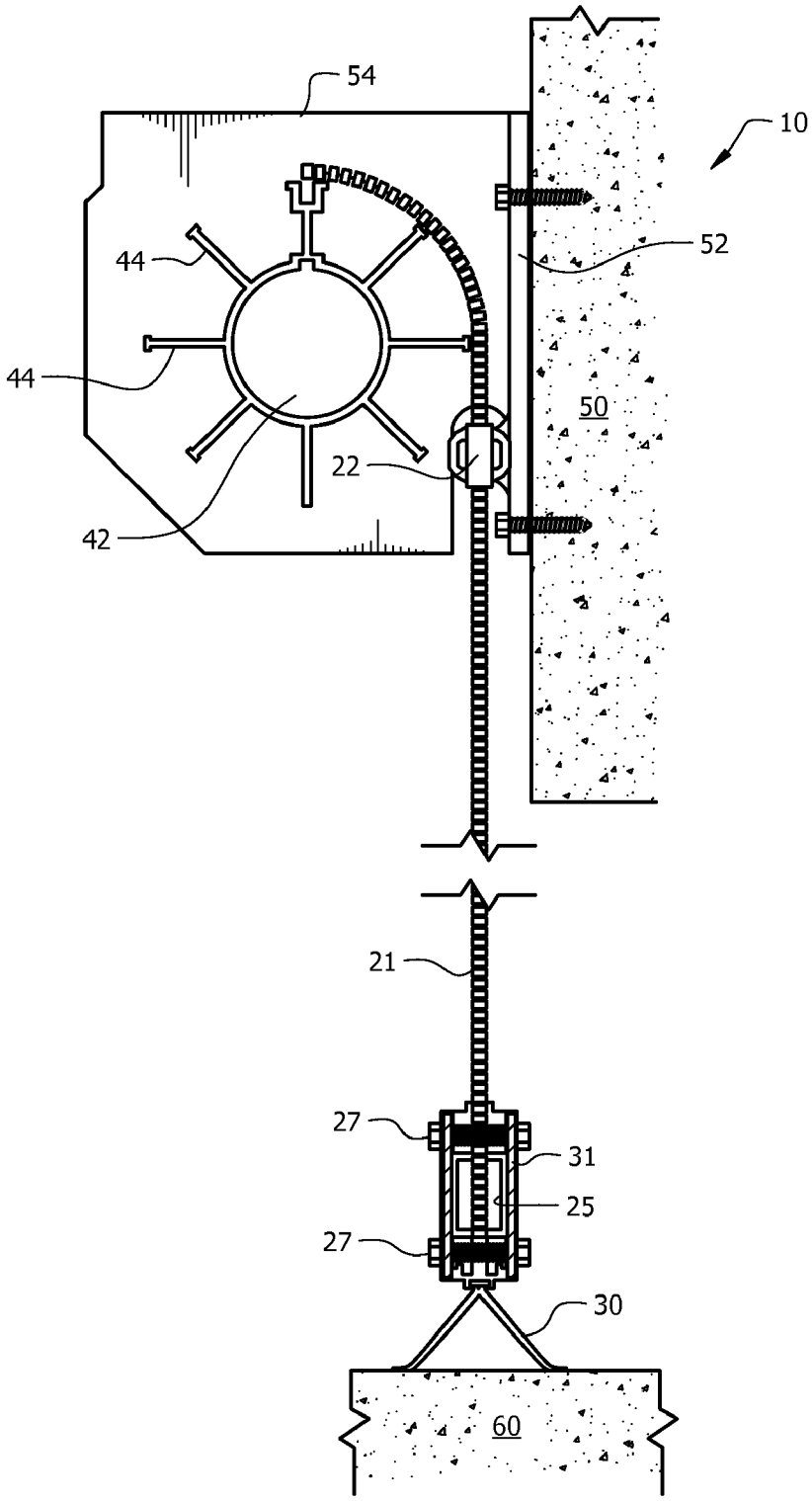
FIG. 5 illustrates a plan view of the present invention.

To help pull the flexible sheets of material 14/16 downward and keep each flexible sheet of material 14/16 taught, the bottom edge of the first flexible sheet of material 14 is connected to a bottom weight 26 and the bottom edge of the second flexible sheet of material 16 is connected to a bottom weight 25. In this example, the bottom weights 25/26 are linear metal frame members and are connected to each other with an l-bracket 28/29 with screws 27. This is an example of bottom weights 25/26 and any known bottom weight arrangement is anticipated by the present invention. In some embodiments, multiple bottom weights 25/26 (one for each flexible sheet 14/16) are used (as shown in FIG. 4). In other embodiments, a continuous bottom weight 25/26 spans two or more flexible sheets 14/16 (as shown in FIGS. 1 and 5).

For completeness, brackets 52 of the support bracket assembly 52/54 are shown attached to a header 50 or other structural member of a building.

Figure 2:
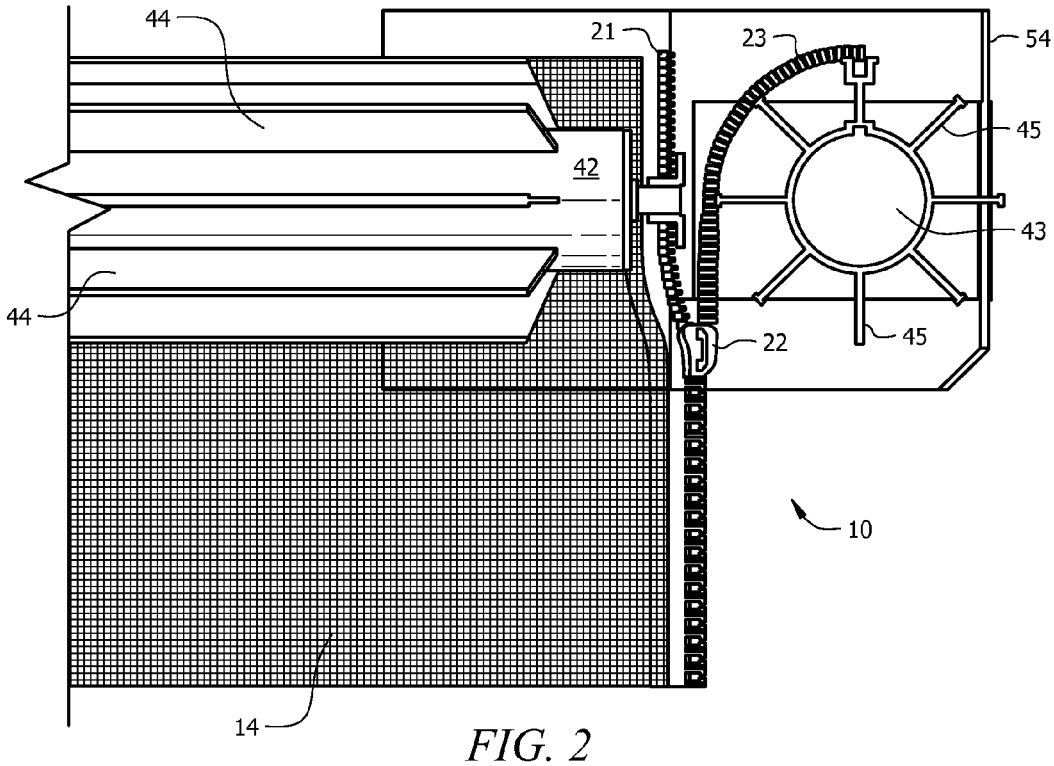
FIG. 2 illustrates a second perspective view of the present invention.

Referring to FIG. 2, a second perspective view of the present invention 10 is shown looking from the front of the first flexible sheet of screen material 14. In this view, the second flexible sheet of screen material 16 is not visible, but the mating set of teeth 23 along the left edge the second flexible sheet of screen material 16 is visible. In this view, the fastener 22 is grounded to the support bracket assembly 54 so that, as the roller mechanisms 42/43/44/45 deploy the flexible sheets of screen material 14/16, the teeth 21 along the right edge of the first flexible sheet of screen material 14 engage with the mating set of teeth 23 along the left edge the second flexible sheet of screen material 16. Likewise, as the roller mechanisms 42/43/44/45 retract the flexible sheets of screen material 14/16, the teeth 21 along the right edge of the first flexible sheet of screen material 14 disengage with the mating set of teeth 23 along the left edge the second flexible sheet of screen material 16.

Figure 3:
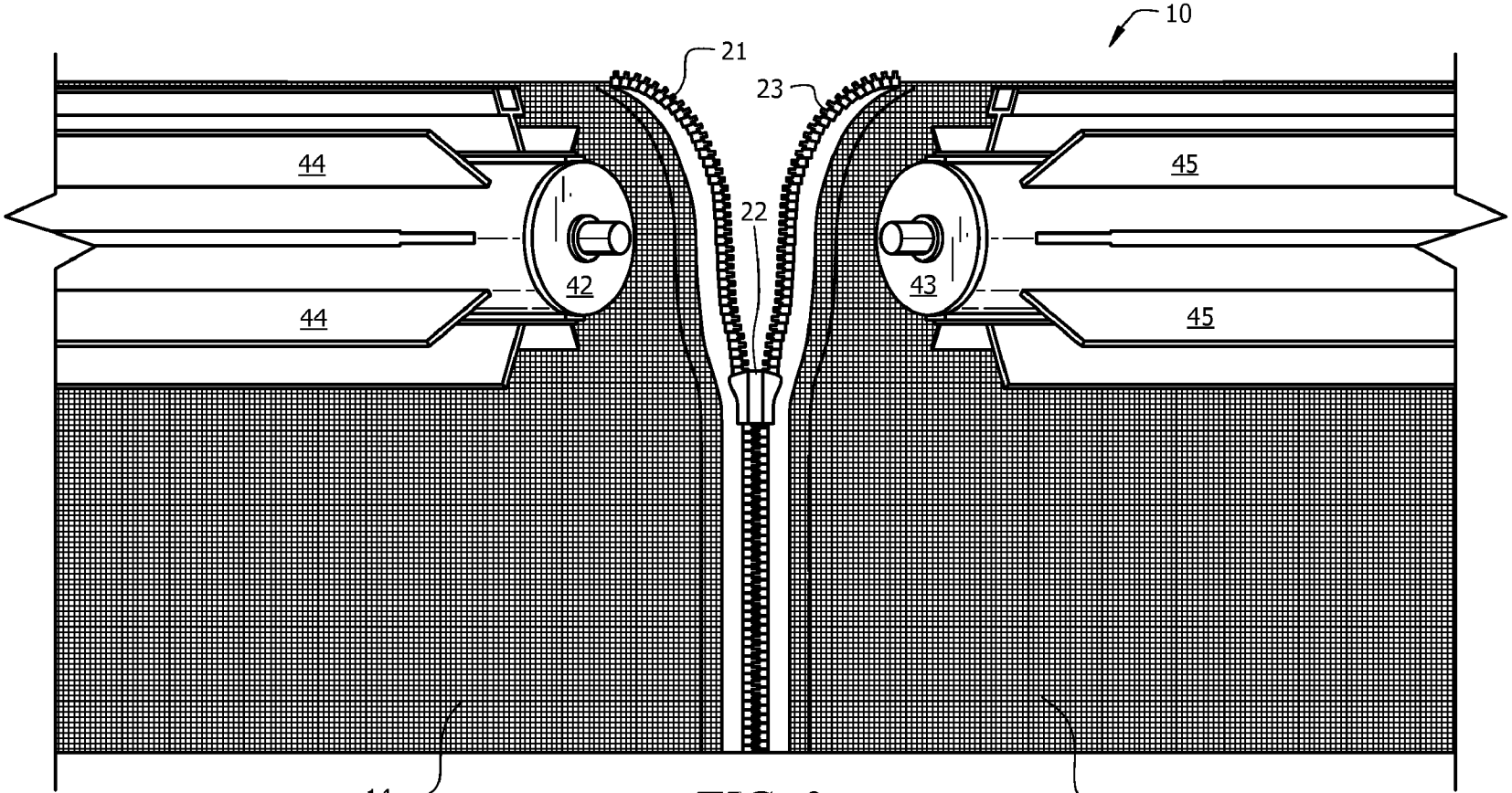
FIG. 3 illustrates a third perspective view of the present invention.

Referring to FIG. 3, a third perspective view of the present invention 10 is shown. In this example, the flexible sheets of screen material 14/16 are shown at an angle to each other, such as a 90 degree angle as shown in FIGS. 1 and 2.

Referring to FIG. 4, a fourth perspective view of the present invention 10 is shown. As in FIG. 3, in this example, the flexible sheets of screen material 14/16 are shown in a linear arrangement in which an axis passes through the first roller mechanism 42/44 and the second roller mechanism 43/45. In this, the flexible sheets of screen material 14/16 are shown fully deployed and the teeth 21 are locked with the mating teeth 23. The bottom weight sections 25/26 hold the flexible sheets of screen material 14/16 taught and enable deployment by pulling the flexible sheets of screen material 14/16 from the roller mechanism 42/43/44/45 as the roller mechanisms 42/43/44/45 turn in a direction of deployment. In some embodiments, a floor interface 30 is provided to improve sealing against uneven floors 60. In such, the floor interface 30 is made of a material that will conform to irregularities of the mating surface (floor) 60. As an example, the floor interface 30 is made of a flexible rubber. Other examples include, but are not limited to, bendable plastic, foam material, bristles, etc.

Referring to FIG. 5, a plan view of the present invention 10 is shown from the side. In this view, the flexible sheets of screen material 14/16 (not visible) are shown fully deployed and the teeth 21 are locked with the mating teeth 23 (not visible). The bottom weight sections 25/26 (only 25 is visible) are joined together by plates 31 held by screws 27 hold the flexible sheets of screen material 14/16 taught and enable deployment by pulling the flexible sheets of screen material 14/16 from the roller mechanism 42/43/44/45 as the roller mechanisms 42/43/44/45 turn in a direction of deployment. In some embodiments, a floor interface 30 is provided to improve sealing against uneven floors 60. In such, the floor interface 30 is made of a material that will conform to irregularities of the mating surface (floor) 60. As an example, the floor interface 30 is made of a flexible rubber. Other examples include, but are not limited to, bendable plastic, foam material, bristles, etc. In this example, the floor interface 30 is an inverted-V shape. As the flexible sheets of screen material 14/16 deploy completely, the inverted-V of the floor interface 30 is pushed against the floor 60 by the weight of the bottom weight sections 25/26, slightly deforming the inverted-V of the floor interface 30, providing an improved seal between the floor interface 30 and the floor 60.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A multi-section screen system comprising:

at least two flexible sheets of fabric, zipper teeth disposed along a side edge of a first flexible sheet of the flexible sheets of fabric and mating zipper teeth disposed along a side edge of an adjoining flexible sheet of the flexible sheets of fabric, the side edge of a first flexible sheet in proximity to the side edge of an adjoining flexible sheet;

at least one bracket supporting adjacent at least two mechanisms of the at least two flexible sheets of screen fabric; the at least two mechanisms for vertically retracting and deploying two adjacent of the at least two flexible sheets of fabric; and at least one fastener fixed to a respective at least one bracket and located between the zipper teeth and the mating zipper teeth, the fastener joining the zipper teeth with the mating zipper teeth as the at least two mechanisms deploy the flexible sheets of fabric and the fastener automatically disengaging the zipper teeth from the mating zipper teeth as the at least two mechanisms retract the flexible sheets of fabric;

whereas each of the flexible sheets are at angles of 10 to 170 degrees with respect to adjacent flexible sheets.

2. The multi-section screen system of claim 1, wherein each of the flexible sheets are at angles of 90 degrees with respect to the adjacent flexible sheets.

3. The multi-section screen system of claim 1, wherein each of the flexible sheets are in a linear arrangement with respect to the other flexible sheets.

4. The multi-section screen system of claim 1, wherein the at least two flexible sheets of screen fabric are at least three flexible sheets of screen fabric.

5. The multi-section screen system of claim 1, further comprising a weighted member disposed along a bottom edge of each of the flexible sheets.

6. The multi-section screen system of claim 5, further comprising a floor interface along a bottom edge of each weighted member, the floor interface is made of a material that conform to irregularities of a mating surface.

7. The multi-section screen system of claim 1, wherein the mechanisms for retracting and deploying each of the flexible sheets of screen fabric include a roller mechanism.

8. The multi-section screen system of claim 7, wherein the roller mechanism includes fins.

9. A method of enclosing an area with multiple flexible sheets of material, the method comprising:

providing the multi-section screen system of claim 7;

turning the roller mechanisms in unison in a first direction resulting in the flexible sheets unrolling from the roller mechanisms, as the flexible sheets unroll from the roller mechanism, the zipper teeth are automatically locked together with the mating zipper teeth by the fastener as the flexible sheets deploy in a vertical direction; and turning the roller mechanisms in unison in an opposite direction resulting in the flexible sheets rolling onto the roller mechanisms, as the flexible sheets roll onto the roller mechanism, the zipper teeth are automatically disengaged from the mating zipper teeth by the fastener.

10. The method of claim 9, wherein a weighted member is disposed along a bottom edge of each flexible sheet.

11. The method of claim 10, wherein the step of turning the roller mechanisms in unison in the first direction is complete when the flexible sheets unroll enough from the roller mechanisms such that a bottom of the weighted member contacts a floor.

12. A multi-section screen system comprising:

a first flexible sheet of fabric, zipper teeth disposed along a right side edge of the first flexible sheet;

a second flexible sheet of the fabric, mating zipper teeth disposed along a left side edge of the second flexible sheet;

a first roller mechanism, a top edge of the first flexible sheet interfaced to the first roller mechanism such that turning of the first roller mechanism in a first direction results in winding of the first flexible sheet around the first roller mechanism and turning of the first roller mechanism in an opposing second direction results in unwinding of the first flexible sheet from around the first roller mechanism;

a second roller mechanism, a top edge of the second flexible sheet interfaced to the second roller mechanism such that turning of the second roller mechanism in the first direction results in winding of the second flexible sheet around the second roller mechanism and turning of the second roller mechanism in the opposing second direction results in unwinding of the second flexible sheet from around the second roller mechanism, wherein an axis of rotation of the first roller mechanism is at an angle of from 10 to 170 degrees with respect to an axis of rotation of the second roller mechanism;

wherein a right end of the first roller mechanism is in proximity to a left end of the second roller mechanism; and a fastener fixed between the first roller mechanism and the second roller mechanism, the zipper teeth and the mating zipper teeth interfaced with the fastener whereas the fastener automatically joins the zipper teeth with the mating zipper teeth as the first roller mechanism and the second roller mechanism turns in the first direction thereby deploying the flexible sheets in a downward, vertical direction, and the fastener automatically disengages the zipper teeth from the mating zipper teeth as the first roller mechanism and the second roller mechanism turns in the second opposing direction, retracting the flexible sheets.

13. The multi-section screen system of claim 12, wherein the first roller mechanism is driven by a first motor and the second roller mechanisms is driven by a second motor, the first and second motors turning each of the first and second roller mechanisms at an equal rate of revolution.

14. The multi-section screen system of claim 11, wherein the first and second roller mechanisms include fins to provide an air gap beneath the first and second flexible sheets while the first and second flexible sheets are disposed around the fins.

15. The multi-section screen system of claim 12, wherein an axis of the first roller mechanism is at approximately right angles to an axis of the second roller mechanism.

16. The multi-section screen system of claim 12, wherein an axis of the first roller mechanism is the same an axis of the second roller mechanism.

17. The multi-screen system of claim 12, wherein the axis of rotation of the first roller mechanism is at an angle of 90 degrees with respect to the axis of rotation of the second roller mechanism.

18. The multi-section screen system of claim 12, further comprising a weighted member disposed along a bottom edge of each of the first and second flexible sheets.

19. The multi-section screen system of claim 18, further comprising a floor interface along a bottom edge of each weighted member, the floor interface is made of a material that conform to irregularities of a mating surface.

20. The multi-section screen system of claim 18, wherein the weighted member comprises two linear weighted members connected to each other by an I-bracket.

* * * * *